US006155868A

United States Patent [19]

Wu et al.

[11] Patent Number: 6,155,868

[45] Date of Patent: Dec. 5, 2000

[54] ELECTRICAL CONNECTOR

[75] Inventors: Ming-Chuan Wu, Shun-Lin; Da-Ching Lee, Tu-Chen, both of Taiwan

[73] Assignee: Hon Hai Precision Ind. Co., Ltd., Taipei Hsien, Taiwan

[21] Appl. No.: 09/379,714

[22] Filed: Aug. 24, 1999

[51] Int. Cl.[7] ..... H01R 9/09

[52] U.S. Cl. ..... 439/495; 439/607

[58] Field of Search ..... 439/260, 495, 439/607–610

[56] References Cited

U.S. PATENT DOCUMENTS

| | | | |
|---|---|---|---|
| 5,695,359 | 12/1997 | Fujikura et al. | 439/495 |
| 5,727,968 | 3/1998 | Ito | 439/495 |
| 5,738,545 | 4/1998 | Igarashi et al. | 439/607 |
| 5,839,916 | 11/1998 | Chishima | 439/495 |
| 5,911,597 | 6/1999 | Oshitani | 439/495 |

*Primary Examiner*—Gary F. Paumen
*Attorney, Agent, or Firm*—Wei Te Chung

[57] ABSTRACT

An electrical connector for connection with an FPC comprises an insulative housing, a plurality of terminals retained in the housing and a conductive shell partially surrounding the housing. Each terminal has a contact member for engaging with a mating connector, and a terminal member. The FPC is inserted into the housing from a mounting surface and a signal pattern of the FPC is adapted to engage with the terminal members of the terminals. The shell forms a stepped retention plate for engaging with a grounding pattern of the FPC. A stuffer bar is inserted into the housing for pressing against the retention plate thereby causing the retention plate to secure the FPC within the housing.

9 Claims, 8 Drawing Sheets

ELECTRICAL CONNECTOR

BACKGROUND OF THE INVENTION

The present invention relates to an electrical connector, and especially to an electrical connector for connecting with an FPC (Flexible Printed Circuit) having a stuffer bar for being inserted into a housing of the connector to secure the FPC therein.

An electrical connector for connection with an FPC usually comprises an insulative housing and a shielding shell adapted to surround the housing. A plurality of terminals are mounted to the housing proximate a mating face thereof. The FPC is inserted into the housing from a mounting face of the housing opposite the mating face to contact the terminals. A pressing member is pivotally mounted to the housing proximate the mounting face for being rotated to press against the FPC thereby securing the FPC within the housing. Pertinent prior art is disclosed in U.S. Pat. No. 5,738,545.

Referring to FIGS. 1 and 2, a conventional electrical connector 1 for connection with an FPC 2 comprises an insulative housing 10 and a first conductive shell 11 adapted to partially surround the housing 10. A plurality of passageways 100 is defined through the housing 10 for receiving corresponding terminals 12. Each terminal 12 includes contact portions 110 and a terminal portion 120 opposite the contact portions 110. The FPC 2 is inserted into the housing 10 from a rear face thereof and a signal pattern 21 of the FPC 2 contacts the terminal portions 120 of the terminals 12. A pressing member 13 is pivotally mounted to the housing 10 proximate the rear face. A second shielding shell 20 partially surrounds the pressing member 13. The pressing member 13 is rotated to press against the FPC 2 around a predetermined axis X thereby securing the FPC 2 within the housing 10 and providing a reliable engagement between the signal pattern 21 of the FPC 2 and the terminal portions 120. Simultaneously, the second shell 20 contacts a shielding pattern 22 of the FPC 2.

Due to current trends, different components of a device are often manufactured at different plants. The components are then transported to another plant to complete assembly of the device. Thus, a structure of each component must be suitable for long distance transportation. The connector 1 is transported in the form of FIG. 1 to be assembled with the FPC 2 to get the configuration of FIG. 2. During the transportation, however, the second shell 20 and the pressing member 13 may be damaged after colliding with other parts of the connector 1 or with unexpected objects outside the connector 1 during transport due to a pivotal movement of the pressing member 13 and the shell 20. Furthermore, the pressing member 13 and the second shell 20 have a complex structure thereby making manufacture both time and cost inefficient.

SUMMARY OF THE INVENTION

Accordingly, the primary object of the present invention is to provide an electrical connector for connection with an FPC having a stuffer bar for securing the FPC within a housing of the connector.

Another object of the present invention is to provide an electrical connector for connection with an FPC which has a simple structure and is easily manufactured.

To fulfill the above-mentioned objects, an electrical connector for connection with an FPC comprises an insulative housing, a plurality of terminals retained in the housing and a conductive shell partially surrounding the housing. Each terminal has a contact member for engaging with a mating connector, and a terminal member. The FPC is inserted into the housing from the rear face and a signal pattern of the FPC is adapted to engage with the terminal members of the terminals. The shell forms a stepped retention plate for engaging with a grounding pattern of the FPC. A stuffer bar is inserted into the housing for pressing against the retention plate thereby causing the retention plate to contact the FPC to secure the FPC within the housing.

Other objects, advantages and novel features of the invention will become more apparent from the following detailed description when taken in conjunction with the accompanying drawings.

DETAILED DESCRIPTION OF A PREFERRED EMBODIMENT

Figure 1:
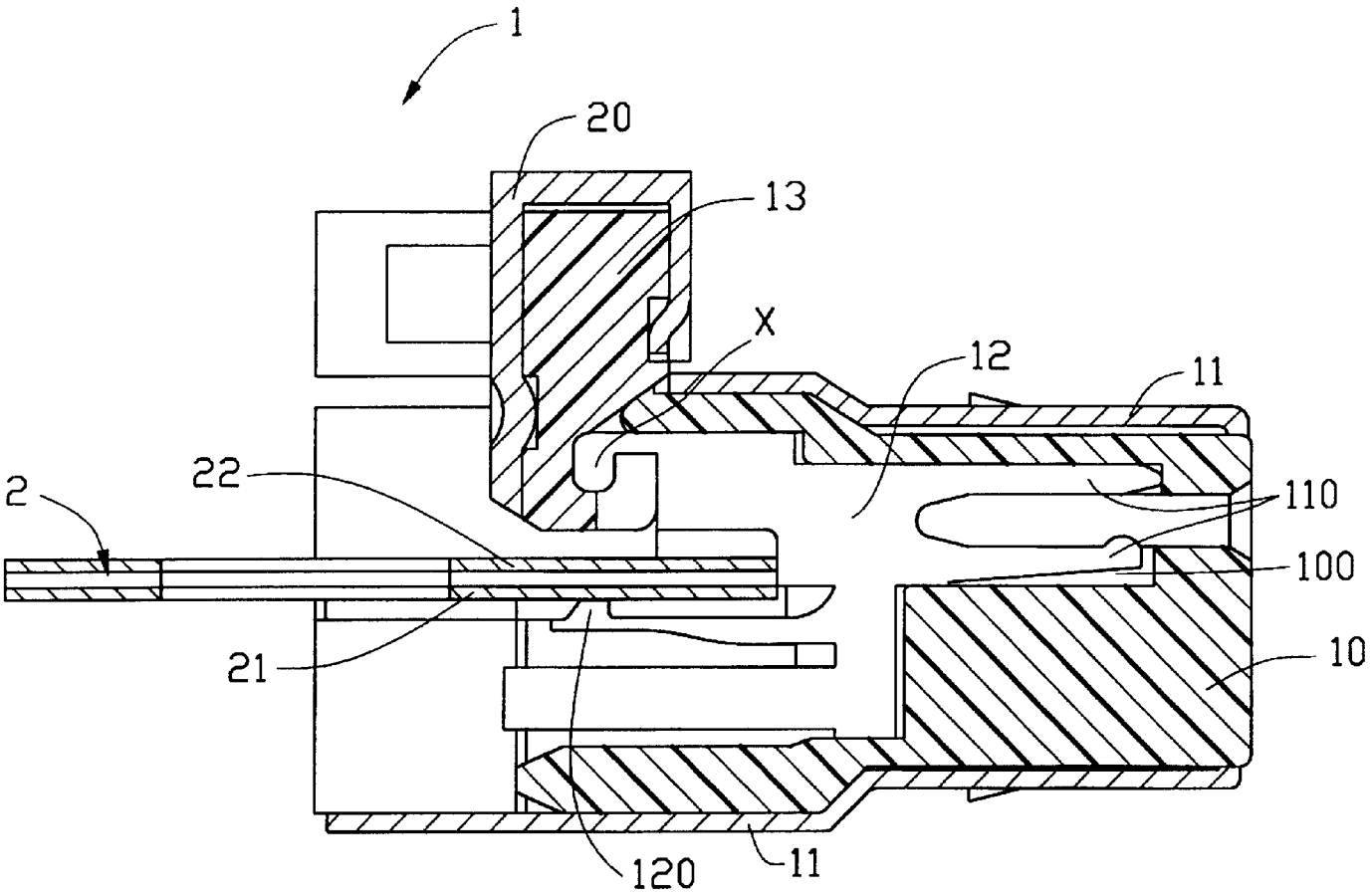
FIG. 1 (PRIOR ART)
FIG. 1 is a cross-sectional view of a conventional electrical connector for connecting with an FPC.
Figure 2:
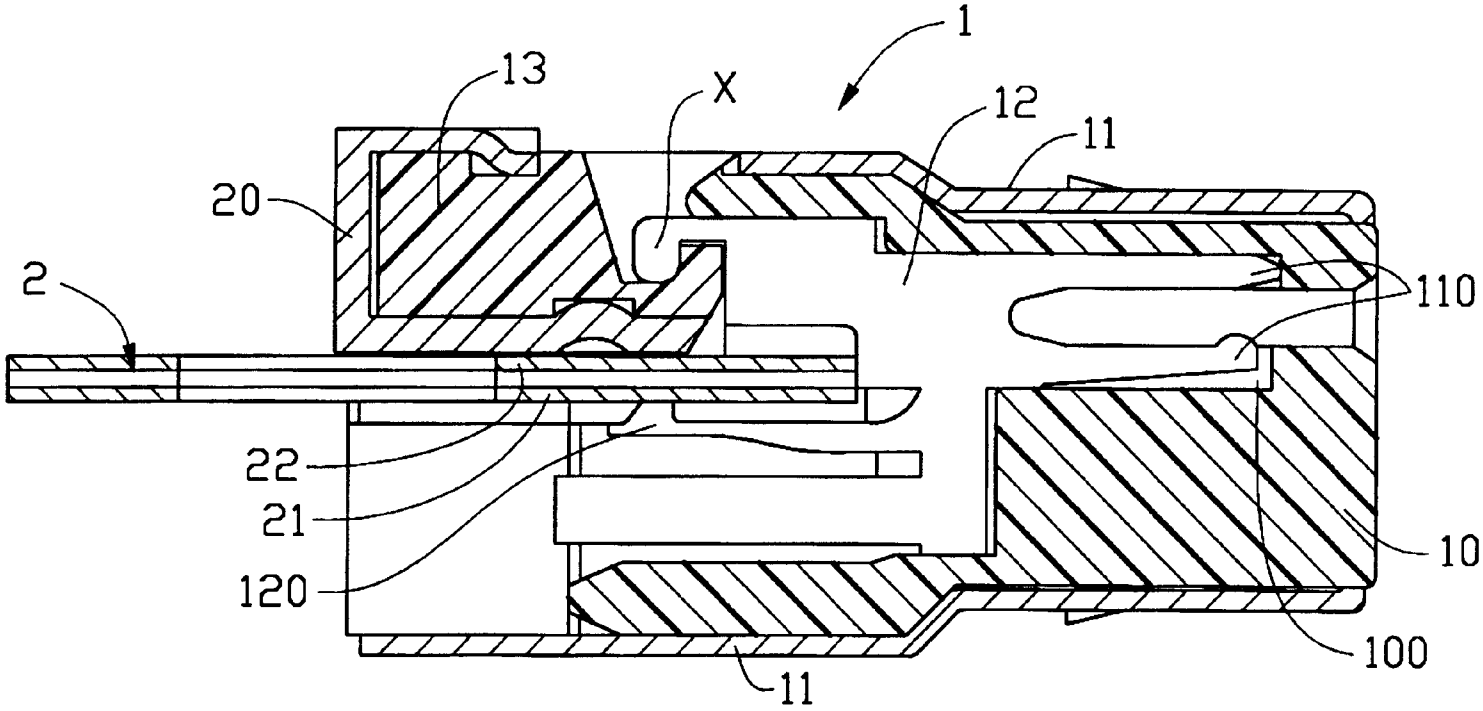
FIG. 2 (PRIOR ART)
FIG. 2 is similar to FIG. 1 showing a pressing member being rotated to press against the FPC.
Figure 3:
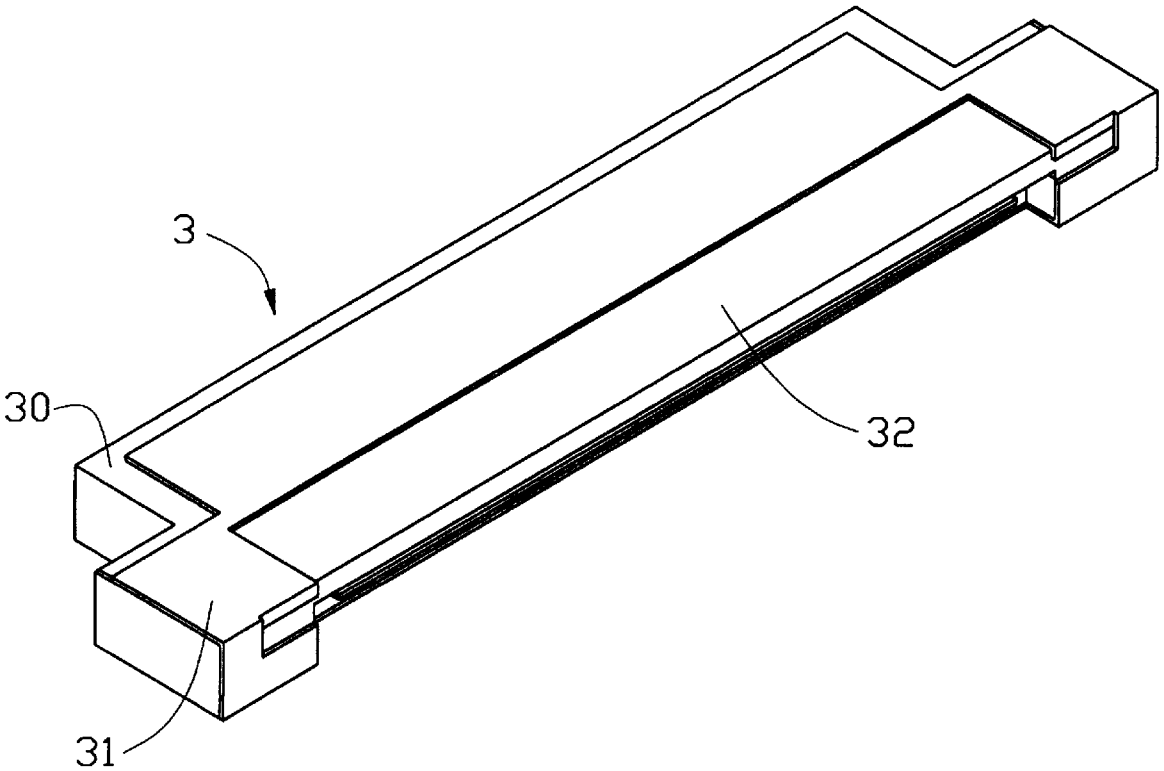
FIG. 3 is a perspective view of an electrical connector for connecting with an FPC in accordance with the present invention.
Figure 4:
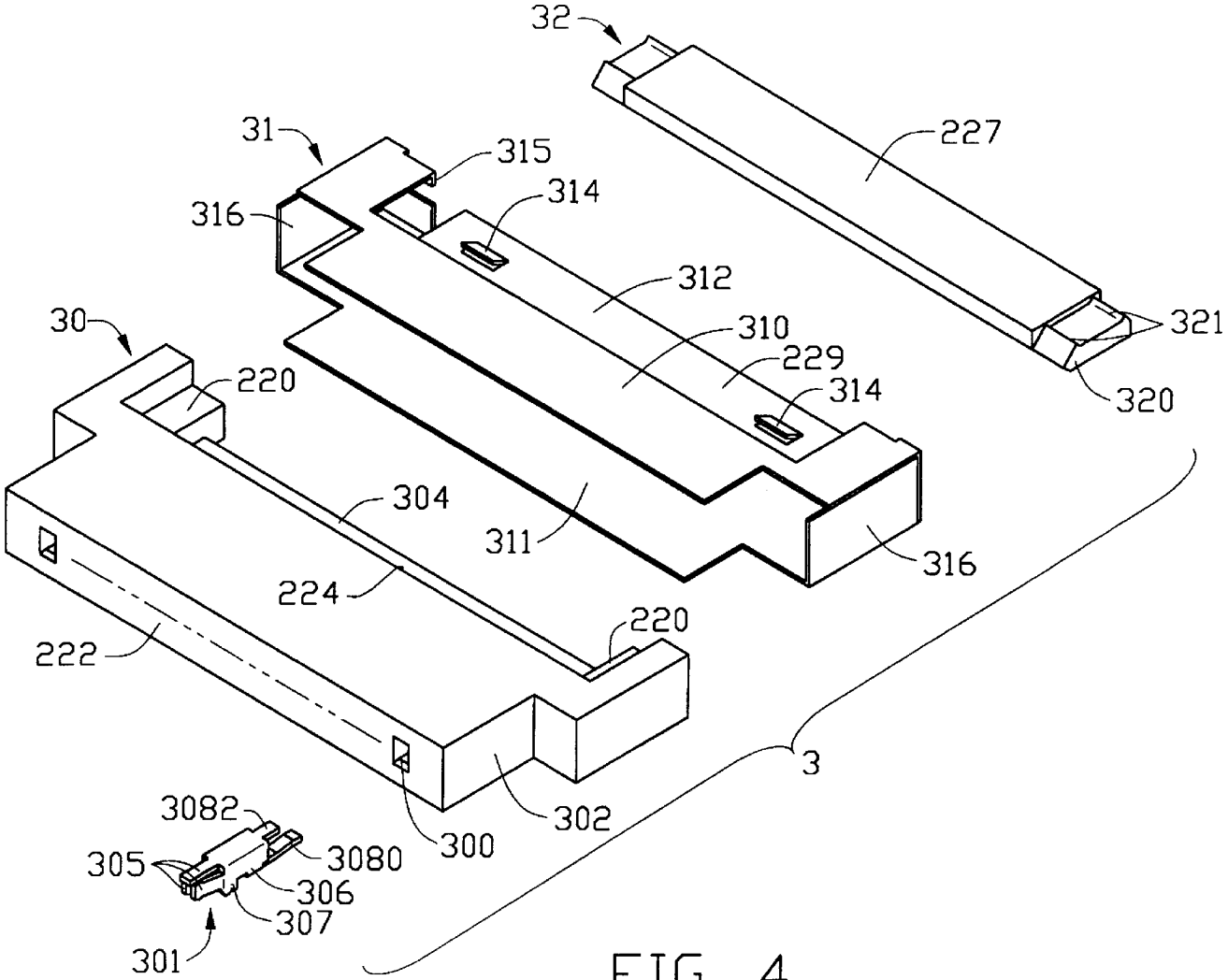
FIG. 4 is an exploded view of FIG. 3.
Figure 5:
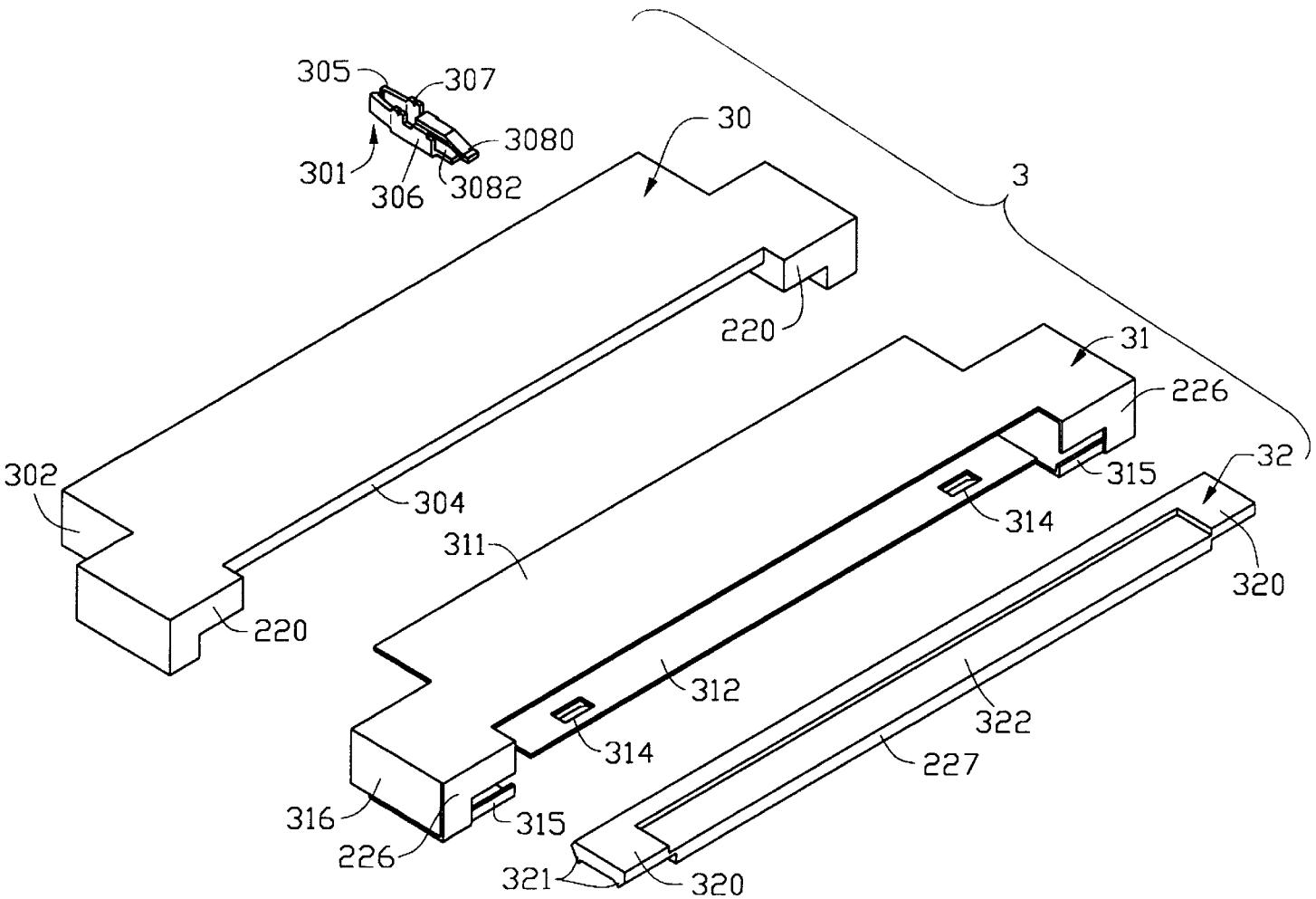
FIG. 5 is similar to FIG. 4 but viewed from a different perspective.

Referring to FIGS. 3–5, an electrical connector 3 in accordance with the present invention comprises an insulative housing 30, a plurality of terminals 301 retained in the housing 30, a shielding shell 31 and an elongate stuffer bar 32.

The housing 30 includes a forwardly extending mating projection 302, a pair of shoulders 220 formed proximate opposite ends of the housing 30, and a rearwardly extending supporting plate 304. A plurality of passageways 300 is defined between a front surface 222 and a mounting surface 224 of the housing 30 for receiving the terminals 301.

Each terminal 301 is unitarily stamped and includes three contact strips 305 at one end thereof, first and second terminal strips 3080, 3082 at the other end thereof, and a center portion 306 between the contact strips 305 and the terminal strips 3080, 3082. Locking barb 307 are formed on edges of the center portion 306 for being interferentially fit in the corresponding passageway 300. The first terminal strip 3080 is longer than the second terminal strip 3082 and has a curved end bent toward the second terminal strip 3082.

The shell 31 is unitarily stamped and includes a top wall 310, a bottom wall 311, and a pair of lateral walls 316 for cooperatively surrounding the housing 30. The top wall 310 is adapted to cover a top surface of the housing 30, the bottom wall 311 is adapted to cover a bottom surface of the housing 30, the lateral walls 316 are adapted to cover opposite lateral surfaces of the housing 30. A pair of rear walls 226 upwardly extends from a rear edge of the bottom wall 311 proximate the lateral walls 316 for covering a rear surface of the housing 30 thereby preventing rearward movement thereof. A stepped retention plate 312 extends from a rear edge of the top wall 310 of the shell 31 and includes a perpendicular portion 228 and a horizontal portion 229 (best shown in FIGS. 6 and 7). A pair of tabs 314 is upwardly stamped from the horizontal portion 229. A pair of flanges 315 downwardly extends from a rear edge of the top wall 310 proximate the lateral walls 316.

The stuffer bar 32 includes an elongate body 227 and a pair of securing ears 320 at opposite ends of the body 227. Each ear 320 forms a pair of upward projections 321. An elongate recess 322 is defined in a bottom surface of the body 227 and exposed to a rear edge (not labeled) thereof.

Figure 6:
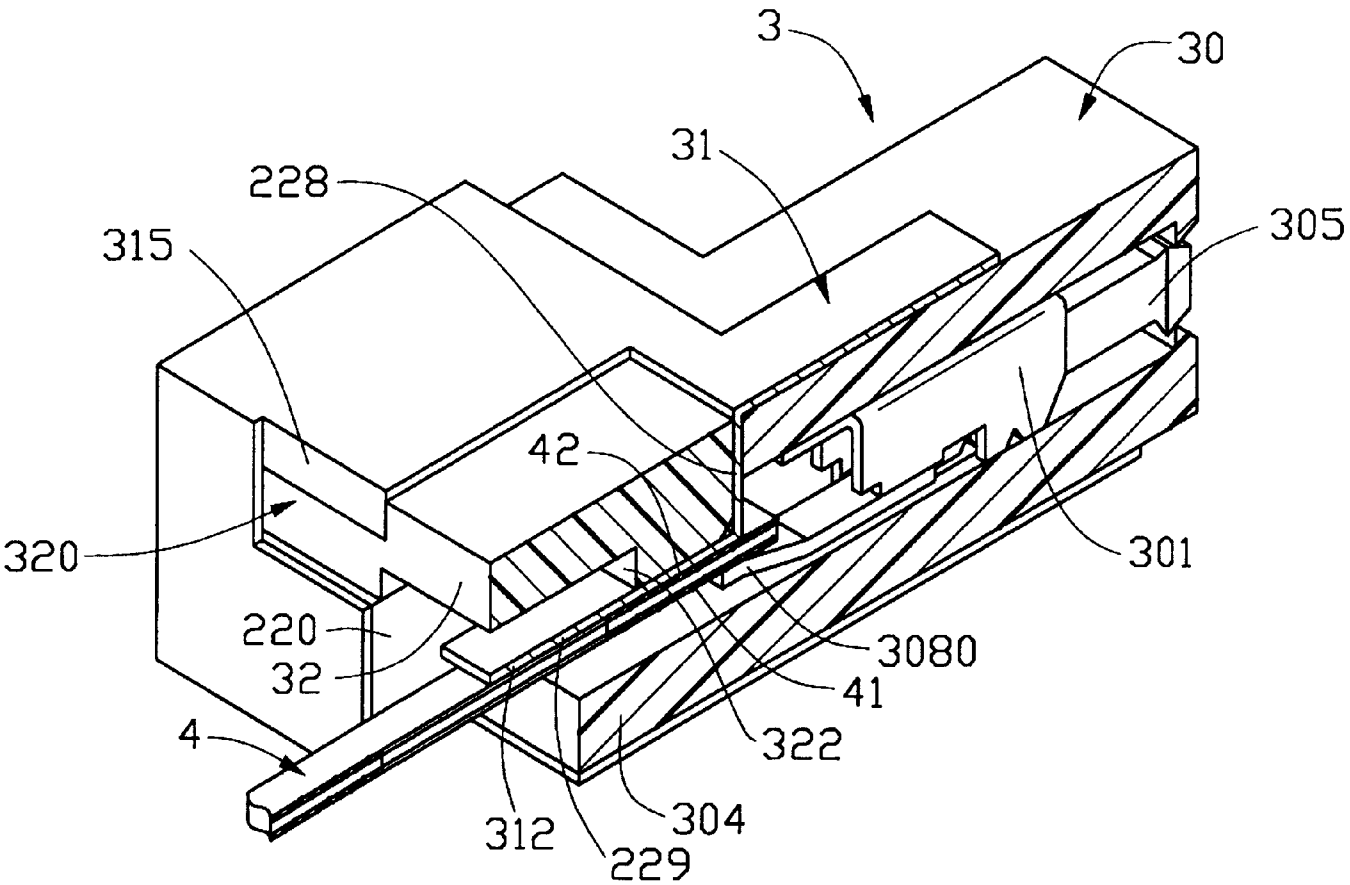
FIG. 6 is a perspective cross-sectional view of the electrical connector showing terminals received therein.
Figure 7:
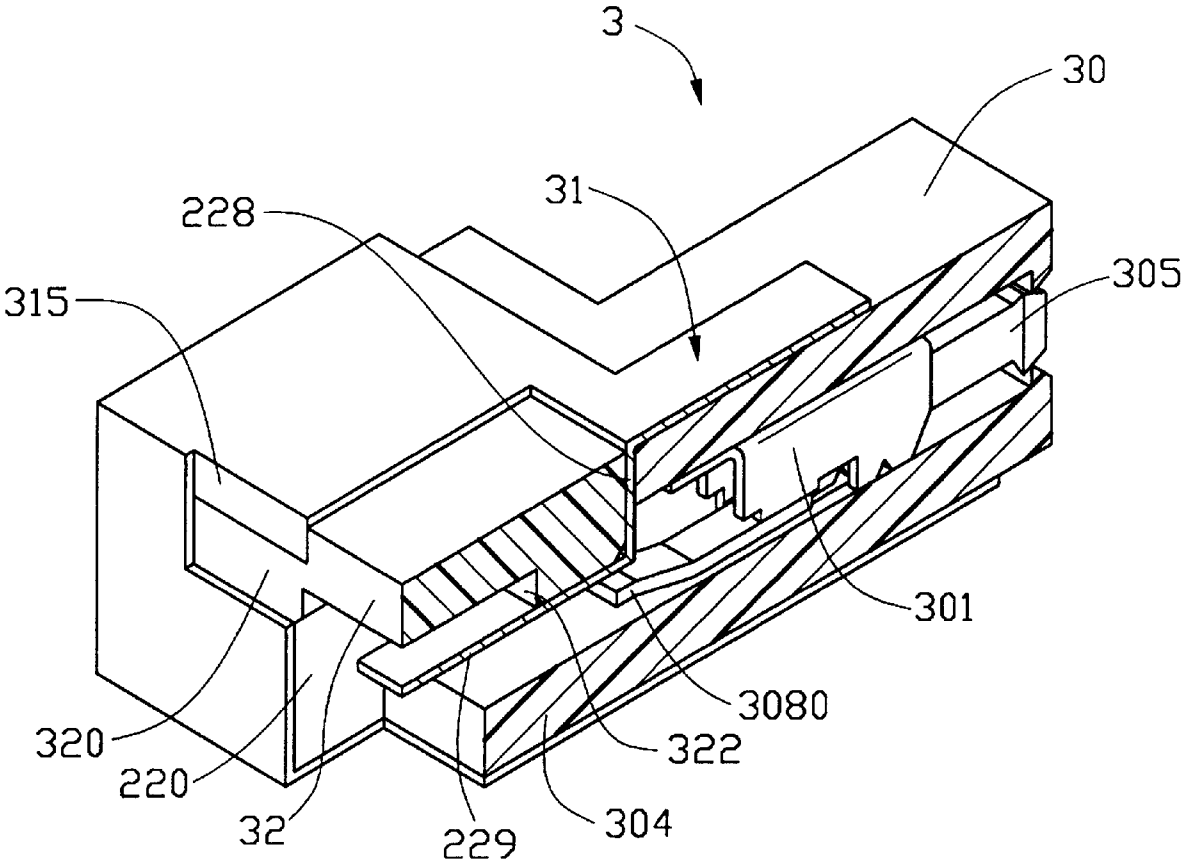
FIG. 7 is similar to FIG. 6 with an FPC inserted into a housing for engaging with a shielding shell and the terminals.

Also referring to FIGS. 6 and 7, in assembly, the terminals 301 are received in the corresponding passageways 300 with the terminal portions 3080 resting on the supporting plate 304. The curved ends of the terminals 3080 are distanced from the supporting plate 304. The shell 31 is then assembled to the housing 30 from the mounting surface 244 thereof. An FPC 4 is inserted into the housing 30 from the mounting surface 224 of and is disposed between the horizontal portion 229 of the shell 31 and the terminal portions 3080 of the terminals 301. Thus, a signal pattern 41 of the FPC 4 engages with the terminal portions 3080 and a grounding pattern 42 of the FPC 4 engages with the horizontal portion 229 of the shell 31. The horizontal portion 229 may be upwardly bent for facilitating insertion of the FPC 4.

Figure 8:
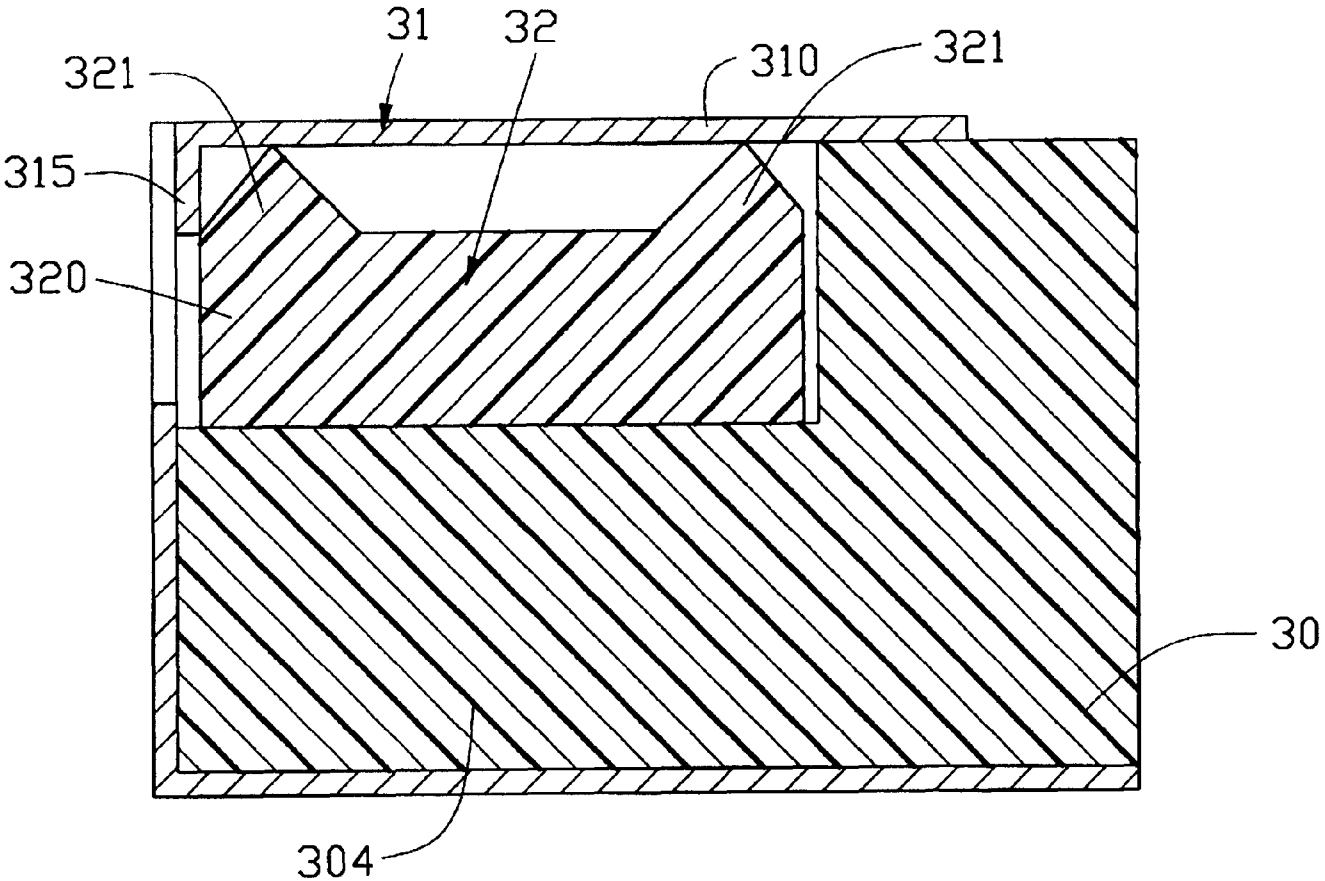
FIG. 8 is a cross-sectional view of an electrical connector of the present invention showing how a stuffer bar engages with the shell.

The stuffer bar 32 is then inserted into the housing 30 from the mounting surface 224 of the housing 30 with the ears 320 resting on the shoulders 220. A front edge of the stuffer bar 32 engages with the perpendicular portion 228 of the shell 31 and the bottom surface of the stuffer bar 32 abuts against the horizontal portion 229 of the shell 31. The flanges 315 of the shell 31 inwardly abut against the rear edge of the stuffer bar 32 thereby preventing outward movement thereof. The tabs 314 of the shell 31 engage an inner edge of the recess 322 thereby further securing the stuffer bar 32 within the housing 30. Referring to FIG. 8, the projections 321 of the stuffer bar 32 engage with the top wall 310 of the shell 31 for further securing the stuffer bar 320. A portion of the recess 322 may be gripped by a tool to remove the stuffer bar 320 from the housing 30.

The stuffer bars 32 and the connectors 3 are separately transported to a plant in which they are assembled with the FPC 4. As there is no pivotable part in the electrical connector 3 in accordance with the present invention. Furthermore, the structure of the connector 3 is simple thereby making manufacture time and cost efficient.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for connection of a flat cable with a mating connector comprising:

an insulative housing defining a plurality of passageways;

a plurality of terminals retained in the passageways of the housing, each terminal including a contact member and a terminal member, the terminal member being adapted to engage with the flat cable inserted into the housing;

a one-piece conductive shell covering the housing and including a retention plate, the retention plate and the terminal members of the terminals sandwiching and engaging the flat cable therebetween; and a stuffer bar inserted into the housing in a direction parallel to the flat cable and pressing on the retention plate.

2. The electrical connector as claimed in claim 1, wherein the retention plate includes a perpendicular portion for abutting against a front edge of the stuffer bar and a horizontal portion for abutting against a bottom surface of the stuffer bar thereby retaining the stuffer bar in the housing.

3. The electrical connector as claimed in claim 2, wherein the horizontal portion of the retention plate forms a pair of outwardly stamped tabs, and the stuffer bar includes an elongate body defining an elongate recess for lockingly engaging with the tabs.

4. The electrical connector as claimed in claim 3, wherein the stuffer bar includes a pair of ears at opposite ends of the body, each ear forming a pair of projections for providing interferential engagement between the stuffer bar and the shell.

5. The electrical connector as claimed in claim 4, wherein the housing forms a pair of shoulders proximate opposite ends thereof for supporting the ears of the stuffer bar.

6. The electrical connector as claimed in claim 1, wherein the housing has a supporting plate for supporting the terminal members of the terminals to engage with the flat cable.

7. The electrical connector as claimed in claim 1, wherein the shell includes a bottom wall, a pair of lateral wall extending from opposite lateral edges of the bottom wall, a rear wall extending from a rear edge of the bottom wall, and a top wall extending from the rear wall and substantially parallel to the bottom wall, the bottom wall, the lateral walls, the rear wall and the top wall being adapted to cover a bottom surface, a lateral surface, a rear surface and a top surface of the housing, respectively.

8. The electrical connector as claimed in claim 7, wherein the retention plate steppedly extends from the top wall of the shell.

9. The electrical connector as claimed in claim 8, wherein the stuffer is held by the retention plate, the rear wall and the top wall of the shell.

* * * * *